US005440978A

United States Patent [19]

O'Brien et al.

[11] Patent Number: 5,440,978

[45] Date of Patent: Aug. 15, 1995

[54] REDUCED VOLUME TRASH COLLECTION SYSTEM

[75] Inventors: Edward J. O'Brien, Eastampton; Nathan D. Bloch, Cherry Hill, both of N.J.

[73] Assignee: Scott Paper Company, Delaware County, Pa.

[21] Appl. No.: 300,192

[22] Filed: Aug. 8, 1994

[51] Int. Cl.[6] ..... B30B 12/00

[52] U.S. Cl. ..... 100/99; 100/229 A; 100/233; 220/264

[58] Field of Search ..... 53/527; 100/99, 229 A, 100/233; 141/391; 220/263, 264, 404, 908, 254; 383/33, 43, 117

[56] References Cited

U.S. PATENT DOCUMENTS

| | | | |
|---|---|---|---|
| 2,384,709 | 9/1945 | Thoren | 220/404 |
| 2,549,572 | 4/1951 | Campanelli | 220/263 |
| 3,744,409 | 7/1973 | Bradbury | 100/102 |
| 3,863,563 | 2/1975 | Popeil | 100/102 |
| 4,164,178 | 8/1979 | Baumann | 100/99 |
| 4,331,074 | 5/1982 | Behman | 100/215 |
| 4,416,197 | 11/1983 | Kehl | 100/214 |
| 4,593,615 | 6/1986 | Kehl | 100/227 |
| 4,913,308 | 4/1990 | Culbertson | 220/404 |
| 5,090,309 | 2/1992 | Lai | 100/226 |
| 5,220,866 | 6/1993 | Mason, Jr. et al. | 100/221 |
| 5,310,078 | 5/1994 | Strawder | 220/908 |

FOREIGN PATENT DOCUMENTS

| | | | |
|---|---|---|---|
| 2659945 | 9/1991 | France | 220/404 |
| 303970 | 9/1968 | Sweden | 220/404 |

*Primary Examiner*—David A. Scherbel
*Assistant Examiner*—Terrence R. Till
*Attorney, Agent, or Firm*—Woodcock Washburn Kurtz Mackiewicz & Norris

[57] ABSTRACT

A waste paper receptacle/compactor employing a container section and a lid section. Suspended within the container section is an expandable liner with a cylinder supported inside of the liner at the top thereof. The cylinder serves as a staging area for placement of spent and crumpled paper towels. The cylinder works in conjunction with a piston which extends down from the lid section. The liner is biased to contract circumferentially. In such manner, when a used desires to discard spent and crumpled paper towels, that user opens the lid section and inserts the towel into the staging area and allows lid section to close thereon. The piston drives the paper towel down into the liner below the cylinder. The inwardly direction bias of the liner prevents the towels from opening or flowering in the container section. A loop is provided at the top of the liner providing a handle for extracting a full liner from the container section. Pulling on the loop to extract a full liner results in an automatic closure of the open end of the liner.

14 Claims, 4 Drawing Sheets

REDUCED VOLUME TRASH COLLECTION SYSTEM

BACKGROUND OF THE INVENTION

1. Field of the Invention

This invention relates generally to containers for collecting refuse, and more particularly, to containers for collecting and compressing paper towel refuse.

2. Brief Description of the Prior Art

There are a variety of trash receptacles known in the prior art with means for compacting the trash within the receptacle. One such trash receptacle is taught in U.S. Pat. No. 4,593,615 to Kehl. The Kehl receptacle includes a container which may be lined with a plastic bag. The bag is held in place by a top assembly which traps an upper portion of the plastic bag between the top assembly and the top of the container. There is a pivotally mounted door in the top assembly which is detachable from the top assembly enabling it to be forced downwardly into contact with the refuse within the container.

U.S. Pat. No. 5,220,866 to Mason, Jr., et al. teaches a trash collection and compaction device wherein a section of the trash container forms a bellows-type arrangement. A second container fits within the first container and the user, by pressing on the first container can compress the bellows causing the base of the second container, to compact the trash within the first container. A plastic bag may line one or both of the containers.

U.S. Pat. No. 5,090,309 to Lai teaches a waste container with a pivotally mounted cover and a press member movably mounted on the cover. The press member includes a plate disposed horizontally within the container which is vertically moveable to compress the refuse within the container.

U.S. Pat. No. 3,863,563 to Popeil teaches a trash compactor which utilizes a plunger sitting atop a support section. Residing within the support section is a bag held in place by a retainer at the top of the support section. The retainer is opened such that the plunger inserts therethrough to compress the trash within the bag. The plunger is hollow providing storage space for bottles or extra bags.

U.S. Pat. No. 3,744,409 to Bradbury, II teaches a waste container and packer including an open top cylindrical receptacle, a plunger reciprocally moveable within the receptacle, and a seat on the upper end of the plunger. A snap ring on the rim of the receptacle guides the plunger in its reciprocal movement and holds a disposable liner within the receptacle. A seat cushion is located atop the plunger such that waste held within the disposable liner is packed or compressed by the weight of the person supported on the seat.

U.S. Pat. No. 4,416,197 to Kehl teaches an apparatus for collecting and compacting waste material which includes a container with a lid member that engages the top of the container to retain a trash bag therein. There is a cover member which fits within an opening through the lid member. The cover member is adapted to be inserted through such opening into the interior of the container and urged downward to compact the contents of the container.

U.S. Pat. No. 4,331,074 to Behman teaches a cover and compacting assembly for trash cans. Such cover assembly includes a compacting member releasably supported in an opening thereof. The compacting member acts as a cover when it is retained in the opening. When it is disengaged from the cover assembly, the compactor can be moved downward to exert compacting force on the material in the trash can.

Although the prior art is replete with waste receptacles which includes means for compacting trash, there is nothing in the prior art which teaches a liner means for preventing paper trash such as paper towels from opening or flowering once it has been compacted within the can or bag and the receptacle is ready for the insertion of additional trash. Further, nothing in the prior art teaches a disposable waste receptacle liner which includes a ring means for aiding in the support of the liner within the receptacle and for also automatically closing the open end of the liner when the liner is removed from the receptacle.

SUMMARY OF THE INVENTION

It is therefore an object of the present invention to provide a paper waste receptacle and compaction apparatus which prevents paper waste such as used and crumpled paper toweling from opening or flowering from within the receptacle after it has been compacted therein.

It is another object of the present invention to provide a paper waste receptacle and compaction apparatus including means for removing a disposable liner from the apparatus which automatically closes the open end of the liner during a removal from the receptacle.

Briefly stated, the foregoing and numerous other objects, features and advantages of the present invention will become readily apparent upon reading of the detailed description, claims and drawings set forth herein. These objects, features, and advantages are accomplished with a waste receptacle/compaction system which employs an expandable mesh liner retained within the container. The expandable mesh liner is generally tubular in configuration and is biased to collapse inwardly. The top of the liner is held open by means of positioning pins supported at the top of the container in which the liner resides. There is further provided a grasping loop which weaves through the expandable mesh liner near the top opening thereof. A reservoir ring inserts into the top portion of the liner thereby expanding the mesh liner only in that area where the reservoir ring resides. The reservoir ring provides a staging area for compacting of paper towel waste by a user. The container section is provided with a finished lid section which can be operated by means of a foot pedal. The lid section includes a piston which normally resides within the reservoir ring when the lid is in the closed position. In operation, the user opens the lid and inserts the crumpled towel into the staging area of the staging area and closes the lid. The lid and piston have enough weight to drive the spent towels to a position below the reservoir ring and into the expandable mesh liner. The bias of the expandable mesh liner keeps the crumpled towels from opening or flowering regardless of how little or how much waste is contained within the liner until the liner is filled. When the liner is substantially filled such that the lid and piston no longer drive the spent towels completely out of the staging area of the cylinder, maintenance personnel need merely remove the reservoir ring or cylinder and extract the liner from the container by pulling on the grasping loop which automatically closes the open end of the liner as it is pulled off of the positioning pins.

DETAILED DESCRIPTION OF THE PREFERRED EMBODIMENT

Figure 1:
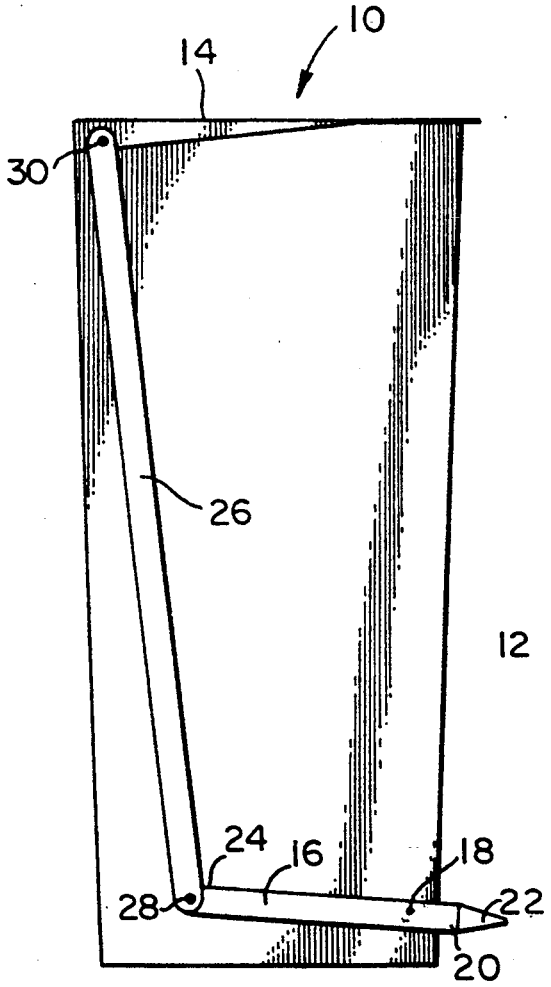
FIG. 1 is a side elevation of the waste paper receptacle/compactor of the present invention.

Turning first to FIG. 1, there is shown the waste receptacle/compactor 10 of the present invention. The waste receptacle/compactor 10 includes a container section 12 and a lid section 14 pivotally connected thereto. There is a lower link 16 located on each side of container section 12 and pivotally connected to container section 12 at pins 18. Extending across the distal ends 20 of lower links 16 is a foot pedal 22. The proximal ends 24 of lower links 16 are connected to upper links 26 by means of pins 28. Upper links 26 are also pivotally connected to lid section 14 by means of pins 30. In such manner, the user can step on foot pedal 22 causing lower links 16 to rotate about pins 18 thereby driving upper links 26 upward opening lid 14.

Figure 2:
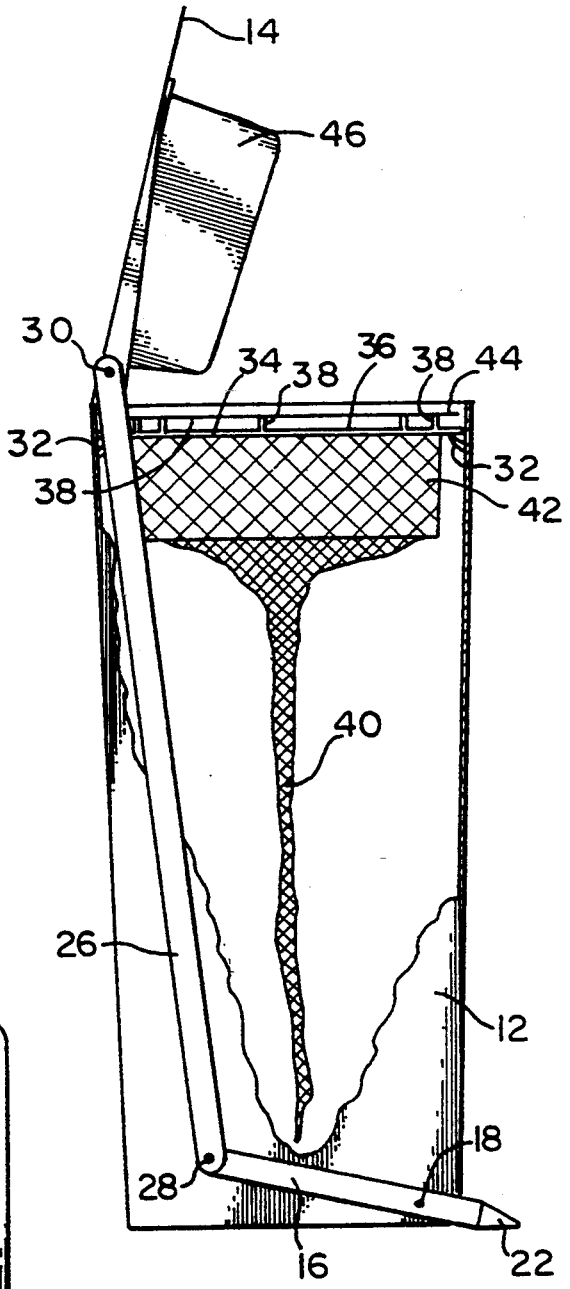
FIG. 2 is a partial cut-away side elevation of the waste receptacle/compactor of the present invention.
Figure 3:
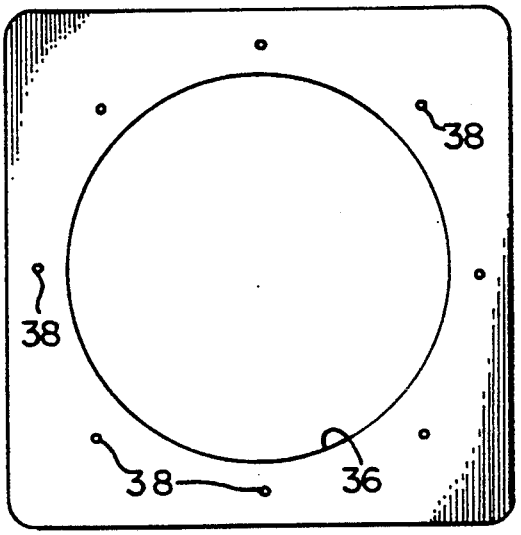
FIG. 3 is a top plan view of the plate member with positioning pins extending therefrom.

Looking next at FIG. 2, there is shown in partial section, the waste receptacle/compactor 10 of the present invention with lid section 14 in the open position. Projecting from the inside surface of container section 12 are a plurality of supports 32. Resting on supports 32 is plate 34 which includes a preferably circular opening 36 (See FIG. 3) therethrough extending upward from plate 34 are a plurality of positioning pins 38. Supported from positioning pins 38 is expandable liner 40. Positioning pins 38 hold the upper end of expandable liner 40 open. Expandable liner 40 is generally tubular in shape and is made from a polyethylene mesh fabric. Suitable polyethylene for liners 40 is the same mesh used for packaging turkeys and can be obtained from Polynet, Inc. of Wilbraham, Mass. The mesh is comprised of individually extruded polyethylene fibers which are sonically welded or heat bonded to each other where the fibers cross. Liner 40 is open on one end and closed on the opposite end. The closed end may be closed by heat sealing, clamping, or the like. The expandable liner 40, because of its mesh design always biases the generally tubular shape thereof to collapse radially inward. The bias of the liner 40 when expanded, actually causes the liner 40 to exert force to contract circumferentially. The liner 40, of course, has an initial perimetric measurement in its normal unexpanded state when empty.

Means other then positioning pins 38 may be used to support expandable liner 40 within container section 12. For example, expandable liner 40 could be supported by clips, hooks, or a snap ring used in conjunction with a plate. Such alternative supporting means can further be used in combination with the inside surface of container section 12 thereby allowing the plates 34 described above to be eliminated.

Figure 4:
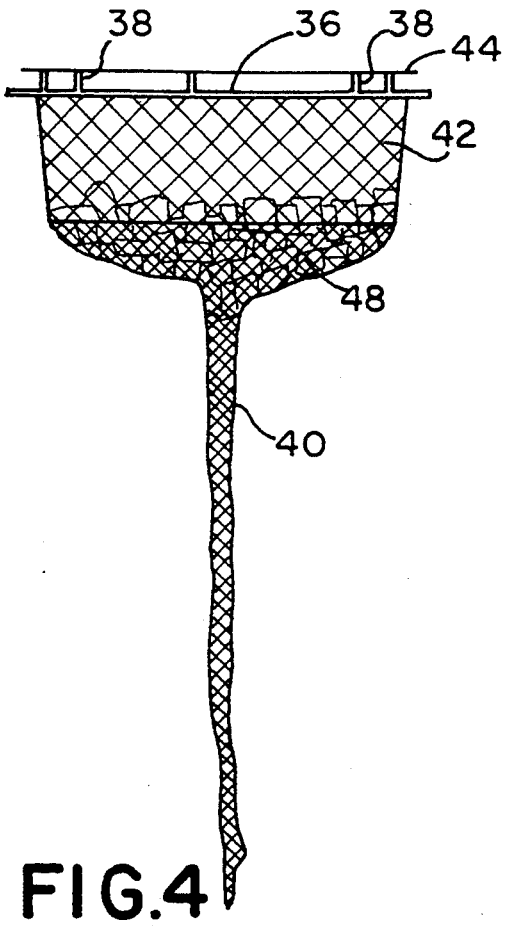
FIG. 4 is a side elevation of the liner and means for supporting the liner with the liner only partially filled.
Figure 5:
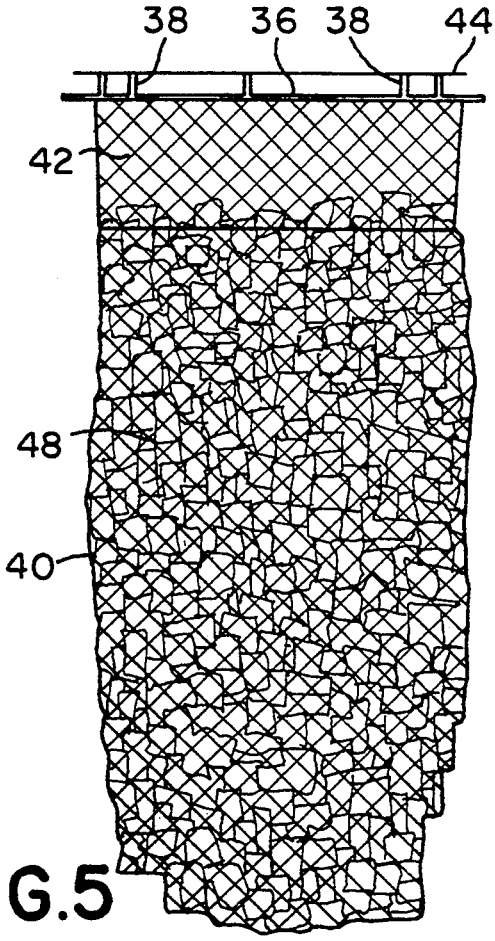
FIG. 5 is a side elevation of the liner and means of supporting the liner with the liner substantially filled with spent towels.

There is a cylinder 42 which is inserted through the opening 36 and into the top of the expandable liner 40. Cylinder 42 includes an annular lip 44 extending therefrom which rests either on the top of positioning pins 38 or on plate 34 thereby supporting the cylinder 42 at the top of the container section 12. Cylinder 42 provides a staging area for paper towel waste to be inserted therein. Extending down from lid section 14 is piston 46 which works in conjunction with ring or cylinder 42. After a user has placed waste paper towel into the staging area of cylinder 42, lid section 14 is allowed to close with piston 46 entering cylinder 42. Piston 46 thereby drives the towel, in its crumpled and compressed condition, down into that portion of liner 40 below cylinder 42. This can be seen more clearly in FIGS. 4 and 5 which depict only the liner 40 in conjunction with cylinder 42, plate 34, annular lip 44, and positioning pins 38. Also depicted in FIGS. 4 and 5 are spent towels 48, which are shown as being maintained in their crumpled, substantially compressed condition by liner 40 below cylinder 42. As can be seen from FIG. 4, expandable liner 40 fills from the top to the bottom because of its inwardly directed bias. Referring specifically to FIG. 5, the same liner 40 is depicted as being completely filled with spent towels 48, again being maintained in substantially crumpled and compressed condition by the bias of expandable liner 40 to contract circumferentially.

Although cylinder 42 and piston 46 are preferably cylindrical in shape, or substantially cylindrical with a slight taper from top to bottom, it will be appreciated by those skilled in the art that cylinder 42 and piston 48 can take other shapes and still function. For example, both could substantially cubical with rounded corners and edges. Almost any hatching polygonal shapes could be used although cylindrical is preferred. Thus, the form "cylinder" as used herein to describe that element which creates the staging area is not intended to limit cylinder 42 as being cylindrical in shape.

Figure 6:
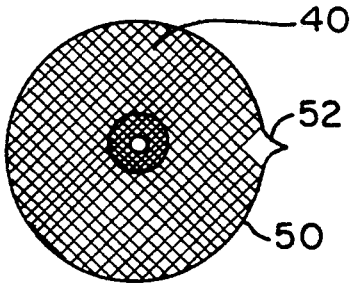
FIG. 6 is a top plan view of an empty liner of the present invention.
Figure 7:
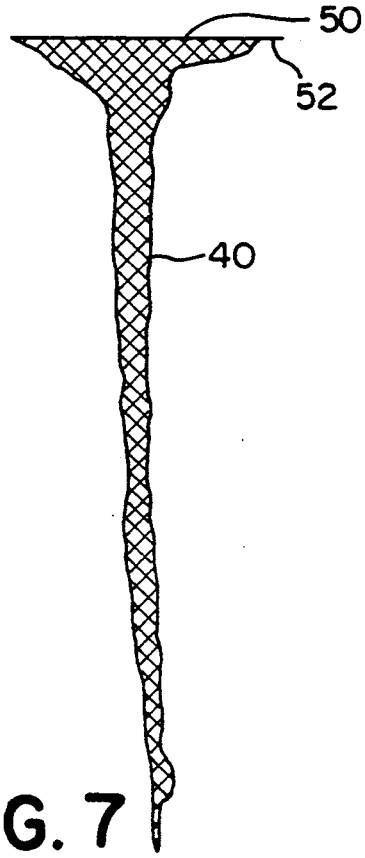
FIG. 7 is a side elevation of an empty liner of the present invention.
Figure 8:
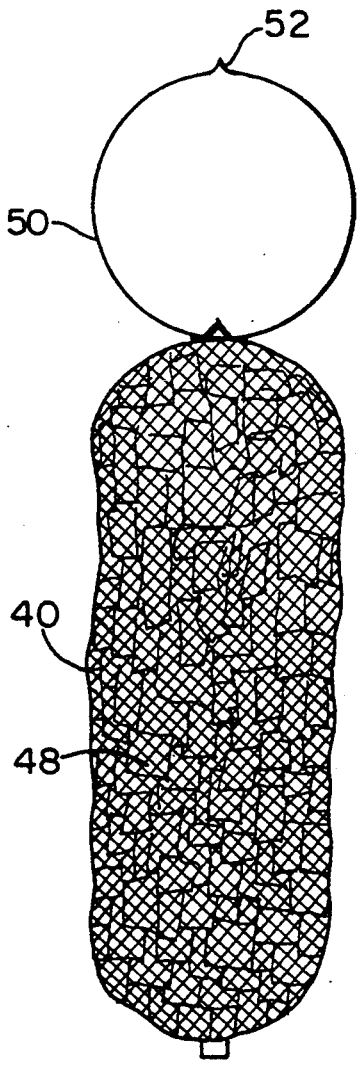
FIG. 8 is a side elevation of a full liner of the present invention where the opening top has been closed by pulling on the loop to remove it from the container section.
Figure 9:
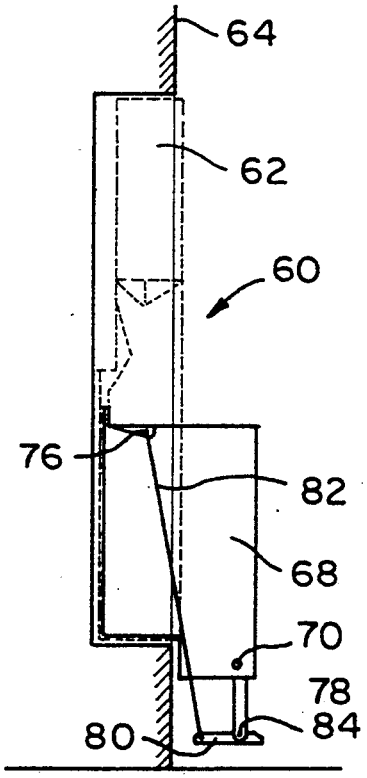
FIG. 9 is a side elevation of an alternative embodiment of the waste paper receptacle apparatus of the present invention for use with a recessed paper towel dispenser.
Figure 10:
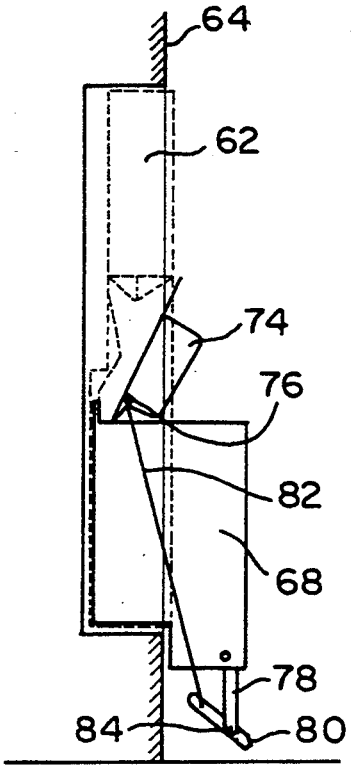
FIG. 10 is a side elevation of the waste paper receptacle apparatus of FIG. 9 with the lid section in an open position.

Looking next at FIGS. 6 of 8, expandable liner 40 is shown in conjunction with loop 50. Loop 50 is a semi-rigid plastic structure which is woven through the mesh fabric of liner 40 at the top thereof. Loop 50 further includes a grasping point 52 facilitating the grasping of loop 50 by maintenance personnel to remove a full liner 40 from a trash receptacle. Extraction of a full expandable liner 40 by pulling on grasping loop 50 automatically causes the top opening in expandable liner 40 to close as the mesh fabric of the liner slides to one location on loop 50. This is shown most clearly in FIG. 8. When a new liner 40 is inserted into the trash receptacle, it is preferable, although not necessary, for most if not all of loop 50 to reside outside of positioning pins 38 to aid in the support and positioning of liner 40.

Turning next to FIGS. 9 through 13 there is shown an alternative embodiment waste receptacle/compactor 60 designed for use in conjunction with a recessed paper towel dispenser 62 of the type typically found in public restrooms. Paper towel dispenser 62 is recessed in a cavity in wall 64. The waste receptacle/compactor 60 is partially recessed in wall 64 and includes a container section 66 residing in a frame 68 to which it is pivotally attached at pins 70. There is a lid section 72 which includes a piston 74. Lid section 72 is pivotally attached to frame 68 and includes a gusset 76 on each side thereof. Extending from the base of frame 68 are a pair of posts 78. Extending between posts 78 is a pivotally mounted foot pedal 80. There is a rod 82 on each side of frame 62 which is connected on one end to foot pedal 80 and on the opposite end to gusset 76. In order to open lid section 72 from container section 68, a user can step on the lead edge of foot pedal 80 causing it to rotate about axle 84 thereby driving rods 82 upward and pivoting lid section 72 away from container section 66. Alternatively, lid section 72 can just be lifted by hand.

Figure 11:
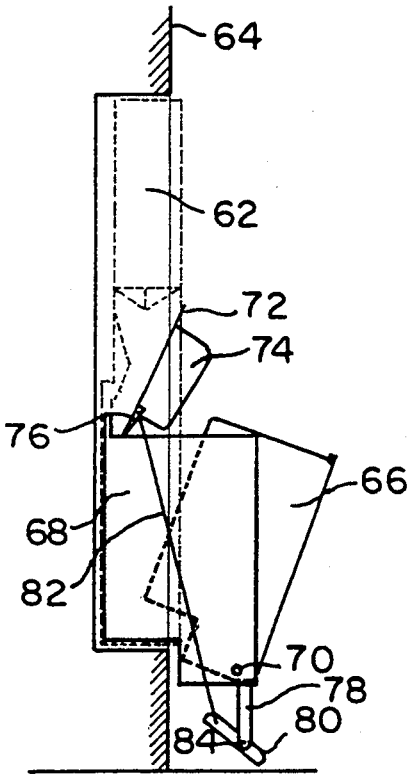
FIG. 11 is a side elevation of the waste paper receptacle apparatus of FIG. 9 with the lid section in an open position and the container section rotated to a maintenance position.
Figure 12:
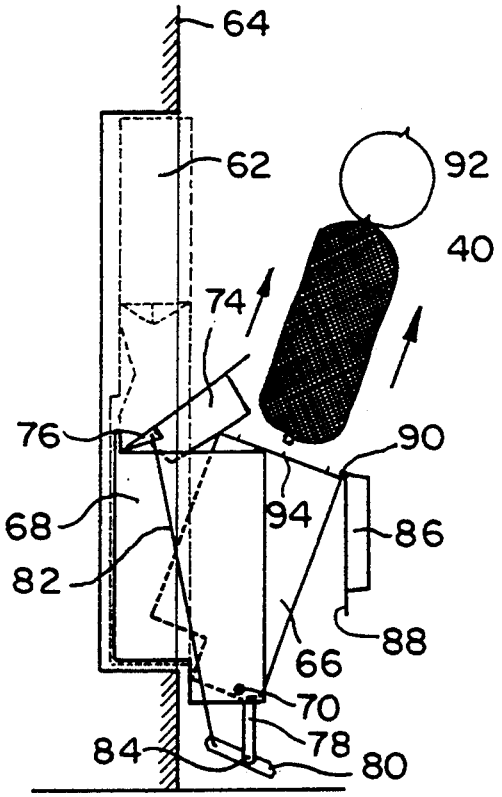
FIG. 12 is a side elevation of the waste paper receptacle apparatus of FIG. 11 with the cylinder rotated away from the top of the container section and showing the removal of an expandable liner that has been filled with waste paper.
Figure 13:
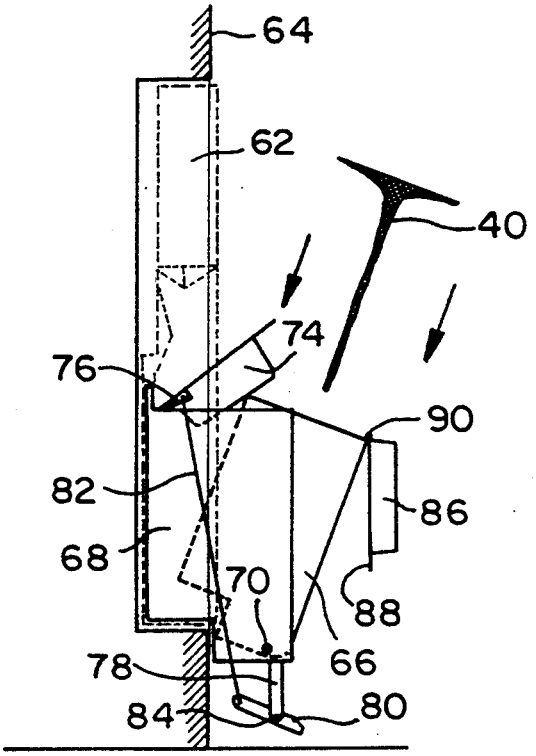
FIG. 13 is a side elevation of the waste paper receptacle depicted in FIG. 12 showing the insertion of a new liner into the container section thereof.

Frame 68 would typically lock into the cavity in wall 64 such that it would be removable only be maintenance personnel. However, it would not be necessary to unlock the frame 68 from the cavity in order to remove a full expandable liner 40, or to install a new expandable liner 40. When the lid section 72 is in an open position, maintenance personnel can pivot container section 66 about pins 70 as shown in FIGS. 11 through 13. Once container section 66 in such rotated position, maintenance personnel can then lift and swing cylinder 86 with annular lip 88 up and out of the open end of container section 66. The cylinder 86 with annular lip 88 is pivotally connected to container section 66 at hinge 90. Using loop 92, the maintenance personnel can remove the full liner 40 automatically closing the top opening on liner 40 in the process (see FIG. 12). Maintenance personnel can then install a new expandable liner 40 onto positioning pins 94 and rotate cylinder 88 back into position at the top of container 66 with annular lip 88 extending of the top of positioning pins 94 (see FIG. 13). Container section 66 can then be rotated back to its normal position within frame 68 and lid section 72 can be allowed to close thereon.

The lid section 14, 72 as shown in the two embodiments described herein, are preferably made of a sheet metal to give them sufficient weight to aid in driving the spent paper towels loaded into the staging area of cylinders 42, 86 down into the expandable liner 40. Other materials including plastics can be used for both the lid sections 14, 72 and the pistons, 46, 74. However, it may be necessary to add additional weight within the pistons 46, 74 in order to ensure that spent towels will be driven down into the expandable liner 40. It has been found that lid sections having a weight in the range of from about 2.5 to about 3.5 pounds is more than sufficient to drive the spent and crumpled towels down into the expandable liners 40.

Despite the fact that, when opening the lid sections 14, 72, the expandable liners 40 will always look full with the exception of the staging area within the cylinders 42, 86, maintenance personnel will known immediately when the liner 40 is actually filled. When lid sections 14, 72 fail to close all the way under their own weight, maintenance personnel such that lid sections 14, 72 remain somewhat ajar, this will serve as an indicator that the expandable liner 40 has been filled all the way to the bottom, and that it is time to remove the full liner 40 and replace it with new liner 40.

From the foregoing, it will be seen that this invention is one well adapted to attain all of the ends and objects herein above set forth together with other advantages which are apparent and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matters herein set forth or shown in the accompanying drawings is to be interpreted as illustrative and not in a limiting sense.

What is claimed is:

1. A waste paper receptacle apparatus comprising:

(a) a container section having an opening in the top thereof;

(b) a lid section for closing said opening;

(c) piston means extending from said lid section;

(d) a plate member supported within said container section proximate to said opening, said plate member having an aperture therethrough;

(e) a plurality of positioning pins extending from said plate member about the periphery of said aperture;

(f) an expandable liner supported from said positioning pins, said expandable liner extending down from said plate member into said container section, said expandable liner being biased to contract circumferentially thereby exerting forces on the contents thereof directed substantially radially inwardly.

2. A waste paper receptacle apparatus comprising:

(a) a container section having an opening in the top thereof;

(b) a lid section for closing said opening;

(c) piston means extending from said lid section;

(d) means in said container section for supporting an expandable liner having an open end and a closed end, said open end being supported proximate to said opening, said means including a plate member for supporting said liner and said plate member being supported by said container section, said expandable liner extending down from said plate member into said container section, said expandable liner being biased to contract circumferentially to an initial perimetric measurement.

3. A waste paper receptacle apparatus as recited in claim 2 further comprising:

a cylinder means supported within said container section proximate to said opening, said cylinder means extending into said expandable liner, said cylinder means forming a staging area for a user to insert used paper towels, said piston means driving used paper towels from said staging area into a lower position within said expandable liner when said lid section is closed.

4. A waste paper receptacle apparatus as recited in claim 3 wherein:

said lid section and said piston means have sufficient combined weight to push used towels in said staging area to said lower position in said expandable liner below said cylinder when said lid section is closed.

5. A waste paper receptacle apparatus as recited in claim 4 wherein:

when said lid section remains ajar upon closing on said container section, such lid section becomes an indicator to maintenance personnel that said expandable liner is full and must be replaced.

6. A waste paper receptacle apparatus as recited in claim 2 wherein:

said means in said container for supporting includes (a) a plate member supported within said container section proximate to said opening, said plate member having an aperture therethrough; and (b) a plurality of positioning pins extending from said plate member about the periphery of said aperture.

7. A waste paper receptacle apparatus as recited in claim 2 further comprising:

pedal means attached to said container section for allowing a user to open said lid section by depressing said pedal means.

8. A waste paper receptacle apparatus as recited in claim 2 wherein:

said expandable liner is a plastic mesh fabric.

9. A waste paper receptacle apparatus as recited in claim 2 further comprising:

a loop means slidably attached to said expandable liner proximate to said open end, said loop means providing maintenance personnel with a handle for lifting a full liner from said container section while automatically closing said open end when said loop means is used to lift said full liner.

10. A waste paper receptacle apparatus as recited in claim 2 wherein:

said container section is pivotally mounted in a frame, said frame being mountable on a wall.

11. A waste paper receptacle apparatus as recited in claim 10 further comprising:

pedal means attached to said frame for allowing a user to open said lid section by depressing said pedal means.

12. A waste paper receptacle apparatus as recited in claim 10 wherein:

said lid section and said piston means have sufficient combined weight to push used towels in said staging area to said lower position in said expandable liner below said cylinder when said lid section is closed.

13. A waste paper receptacle apparatus as recited in claim 12 wherein:

when said lid section remains ajar upon closing on said container section, such lid section becomes an indicator to maintenance personnel that said expandable liner is full and must be replaced.

14. A waste paper receptacle apparatus as recited in claim 10 further comprising:

a loop means slidably attached to said expandable liner proximate to said open end, said loop means providing maintenance personnel with a handle for lifting a full liner from said container section while automatically closing said open end when said loop means is used to lift said full liner.

* * * * *